US005860636A

United States Patent [19]

Duncan et al.

[11] Patent Number: 5,860,636

[45] Date of Patent: Jan. 19, 1999

[54] FENCE POSTS AND THE LIKE

[75] Inventors: Ernest John Duncan, Narangba; Daniel John Boissevain, Kyogle, both of Australia

[73] Assignee: Tristar Fencing Australia Pty Limited, Milsons Point, Australia

[21] Appl. No.: 732,265

[22] PCT Filed: Apr. 20, 1995

[86] PCT No.: PCT/AU95/00225

§ 371 Date: Oct. 18, 1996

§ 102(e) Date: Oct. 18, 1996

[87] PCT Pub. No.: WO95/29313

PCT Pub. Date: Nov. 2, 1995

[30] Foreign Application Priority Data

Apr. 20, 1994 [AU] Australia ..... PM5215

[51] Int. Cl.[6] ..... E04H 17/00

[52] U.S. Cl. ..... 256/1; 256/48; 256/DIG. 5

[58] Field of Search ..... 256/1, 32, 47, 256/48, DIG. 5, 59, 65, 21, 22, 52, 53, 58, 6, 7; 52/729.1, 729.5, 731.7

[56] References Cited

U.S. PATENT DOCUMENTS

| | | | |
|---|---|---|---|
| 359,178 | 3/1887 | Randall | 256/65 X |
| 851,445 | 4/1907 | Seymour | 256/48 |
| 910,192 | 1/1909 | Grouvelle et al. | 256/DIG. 5 X |
| 1,183,047 | 5/1916 | Suhren | 256/48 X |
| 3,332,189 | 7/1967 | Blatnik | 256/48 X |

FOREIGN PATENT DOCUMENTS

| | | | |
|---|---|---|---|
| 212277 | 1/1958 | Australia | 256/47 |
| 172075 | 2/1986 | European Pat. Off. | 256/DIG. 5 |
| 2706493 | 8/1978 | Germany | 256/DIG. 5 |

*Primary Examiner*—Harry C. Kim
*Attorney, Agent, or Firm*—Abelman, Frayne & Schwab

[57] ABSTRACT

The invention provides an elongate member (10) usable inter alia as a fence post, formed to constant cross section by a suitable sheet metal roll forming process, the member when viewed in cross section having three arm sections (15, 16, 17) each of double sheet metal thickness radiating from a junction (18), two of the arm sections (15, 16) at their outer edges remote from the junction having their two sheet sections joined through an integral arcuate or other box-section formation (19, 20), while the third arm section (17) has a like formation (21) in which the free terminal edge (11) of one sheet section is contained within a terminal roll (22) of the other sheet section. When used as a fence post, apertures (14) may be provided along one arm section to receive wire, while the normally lower end (13) is pointed to facilitate driving into the ground.

9 Claims, 2 Drawing Sheets

FENCE POSTS AND THE LIKE

TECHNICAL FIELD OF THE INVENTION

THIS INVENTION relates to fence posts and the like, and while the invention will be found extremely applicable to fence posts, it will become apparent from the disclosures herein that a wide variety of applications therefor can be found including structural beam usages by way of example.

BACKGROUND ART

Fence posts in the form of heavy solid lengths of metal such as black iron are being used increasingly wherever they can be applied, but they suffer from obvious disadvantages in the three areas of being undesirably heavy, involving resultantly high cost, and being very subject to rusting. The latter problem can be reduced by hot dip galvanising before user but the benefit is reduced by the added expense. It has been considered undesirable to reduce the metal content or material volume in order to reduce the cost since this results in a weaker article.

Our present invention has been devised with a view to overcoming the aforementioned problems associated with fence posts as currently used, and it has for its principal object the provision of a novel form of post which will achieve all current requirements yet can be made more cheaply and with less weight for a given length, and which will not be subject to rust problems. More particularly, the invention aims to achieve these benefits by producing a novel elongated member by roll forming galvanised sheet steel to cross-sections not previously attained. Other objects and advantages of the invention will be more fully appreciated from the subsequent descriptions herein.

DISCLOSURE OF THE INVENTION

With the foregoing and other objects in view, our invention resides broadly in an elongate member usable inter alia as a fence post, formed to constant cross-section by a suitable sheet metal roll forming process, said member when viewed in cross-section having three arm sections each of double sheet thickness radiating from a junction, two of said arm sections at their outer edges remote from the junction having their two sheet sections joined through an integral arcuate or other box-section formation, while the third said arm section has a like formation in which the free terminal edge of one sheet section is contained within a terminal roll of the other sheet section.

In accordance with one preferred practical embodiment of the invention, the elongate member has three arm sections at about equal angles to one another and each terminating in a near-circular box-section formation at the outer edges; and in its obvious application as a fence post, apertures to receive wire are provided at intervals along one of the arm sections, while the end which is lowermost in use is shaped to a point for driving into the ground. However, the box-section formations at the outer edges of the three arm sections could be of other shapes such as triangular. In addition, the angles between the arm sections can be unequal to desired degree, while in one embodiment it is preferred that two of the arm sections be substantially co-planar and at right angles to the third section which would most suitably have therein the free edge extremities of the initial metal sheet from which the member is roll formed. Such a T-section elongate member would when desired provide a web of maximum width to accommodate, for example, a strip of reflective tape when used for road markings.

The use of galvanised steel sheet will facilitate suitability as non-rusting fence posts or pickets, the thickness of the steel sheet being selected according to the intended application. While the roll formed member may be provided easily with apertures for wires, suitable wire-securing clips could be used instead of apertures. Elongate members according to the invention are also very usable in fabricated beams or joists as inclined strengthening struts therein which will be light and relatively cheap and yet of considerable strength for the desired purposes. Other features of the invention will be hereinafter apparent.

BRIEF DESCRIPTION OF THE DRAWINGS

In order that the invention may be more readily understood and put into practical effect, reference will now be made to the accompanying drawings, wherein.

Figure 1:
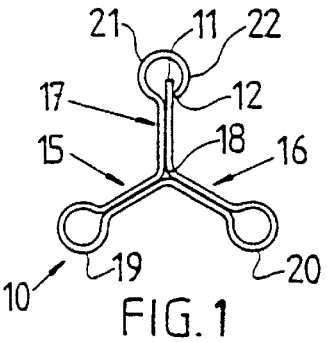
FIG. 1 is a cross-sectional view on line A—A of an elongate member such as a fence post, in accordance with a preferred embodiment of the invention, given by way of example only.
Figure 2:
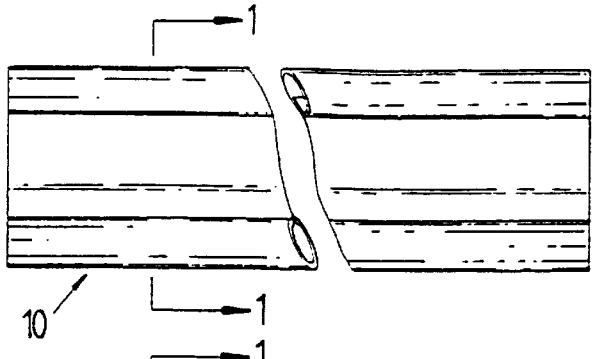
FIG. 2 shows in side elevation a length of elongate member of the cross-section shown in FIG. 1, ready to be adapted to desired application.
Figure 3:
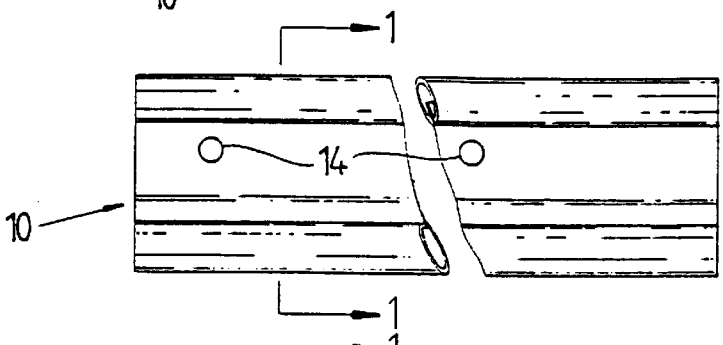
FIG. 3 is similar to FIG. 2 but with apertures along one radial web or arm of the elongate member.
Figure 4:
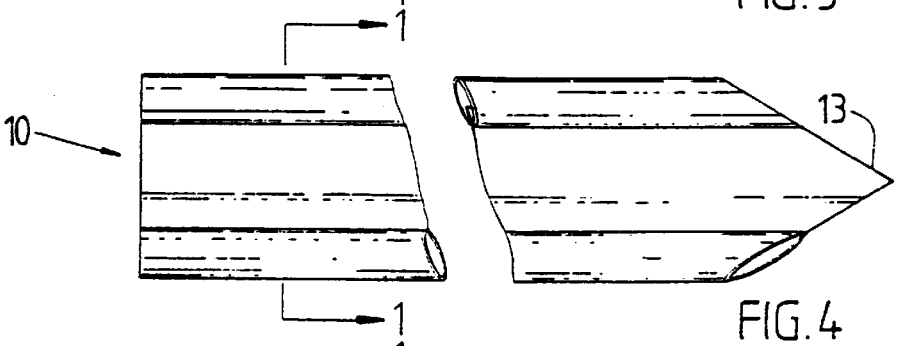
FIG. 4 is also similar to FIG. 2 but with one end cut away to a point for driving into the ground.
Figure 5:
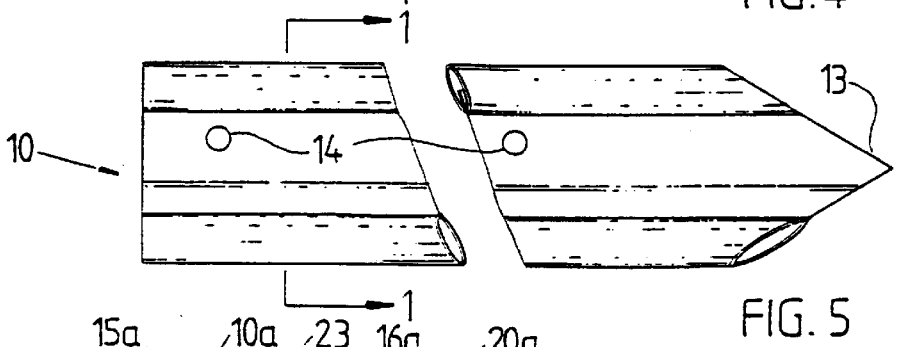
FIG. 5 shows in side elevation an elongate member according to the invention, being a fence post having apertures and a pointed end.

Referring initially to FIGS. 1 to 5 and 7 and 8 of the drawings, the elongate member 10 shown by way of example therein is roll formed from a sheet of galvanised steel having longitudinal side edges indicated at 11 and 12 in FIG. 1. One end can be cut away at 13 to provide a penetration point, and apertures 14 can be provided as desired for fence wires. It will be seen from FIG. 1 that the roll formed elongate member is of constant cross-section and includes three arm sections indicated generally by the numerals 15, 16 and 17, each being of a thickness constituted by a doubled sheet radiating from a middle junction 18. Two of the arm sections, being the sections 15 and 16, have their two sheets joined through arcuate or near-circular box-section formations marked 19 and 20 respectively, while the third arm section 17 has a similar near-circular box-section formation 21 in which the free edge 11 is contained within a terminal roll portion 22 adjacent the other free edge 12, the edge 12 thus sealing against the sheet portion adjacent the other edge 11. Instead of having three arm sections spaced about equally from one another as in FIG. 1, other cross-sections could be employed such as that shown in FIG. 6 in which the corresponding components are given the same numerals as in FIG. 1 but suffixed by the letter "a". It will be noted that the box-section formation 19*a*, 20*a* and 21*a* are of triangular shape in cross-section, while the two arm sections 15*a* and 16*a* are coplanar so that a broad outermost face 23 is presented to accommodate a reflective strip of tape, for example, for use in road markings when desired, the third arm section 17*a* in this instance being at right angles to the other aligned pair of arm sections 15*a* and 16*a*.

Figure 6:
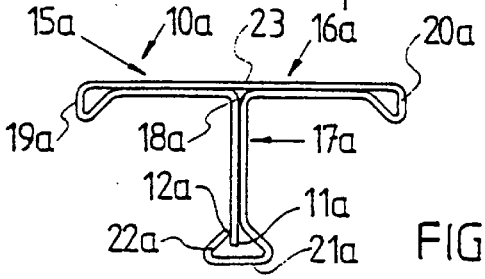
FIG. 6 is a cross-sectional view of a modified form of elongate member, as compared with that of FIG. 1, and which will serve to illustrate the many modifications available within the broad scope of the invention.
Figure 7:
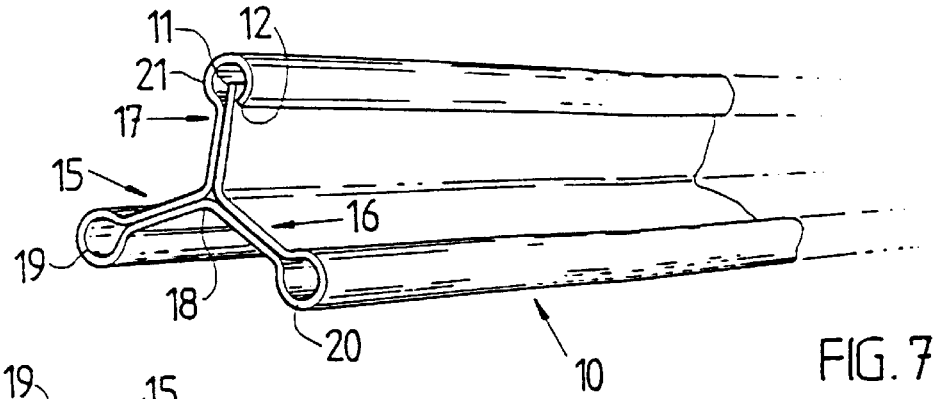
FIG. 7 shows in perspective view a length of section corresponding to FIGS. 1 and 2.
Figure 8:
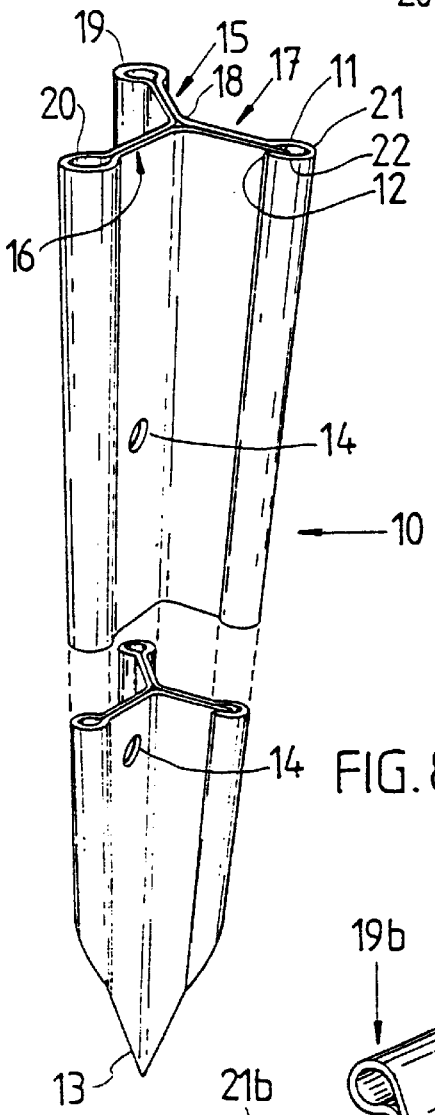
FIG. 8 shows in perspective view a length of metal section, provided with wire-receiving apertures and a pointed bottom end, corresponding to that shown in FIGS. 1 and 5.

In both illustrative forms of the invention, as in FIG. 1 or FIG. 6, each "web" or arm section achieves strength through the double metal thickness, being brought together as close as possible at the innermost junctions 18 and 18*a*, while the outer box-section "bend back" arrangements also ensure maximum strength, being a major novel feature of the invention.

As previously mentioned, unapertured posts are usable if strongly gripping clips for the fence wires are used, but normally apertures will be provided, in which case the web or arm section concerned may be of greater width to offset the metal removal. For example, a typical post may have two webs each 25 mm in the outward direction, while the third web having the apertures might be 30 mm in the corresponding direction. The roll formed sheet steel may be of desired thickness to suit the application, but so selected as to be able to be bent to the sections described herein, while ensuring adequate strength and no unnecessary weight and material volume. Light weight sheets may typically be about 0.8 mm thickness, with thickness increasing to 1.2 mm or as desired for heavier members.

It will be apparent that the invention deals effectively with the original problems of cost, weight and rust, providing articles which are strong, light in weight, made easily of non-rusting material, and being able to be made easily, cheaply and without manufacturing difficulties. All this is possible because of our use of roll forming to produce an article having the aforestated novel features, the roll forming aspect having other advantages such as being able to produce modifications, changes and alternate forms so far as shape, weight and strength are concerned. We have found that in general the articles made in accordance with the invention need have only about two-thirds of the weight of prior standard posts to provide equal useability and efficiency.

A particular feature of the invention is that it lends itself to the manufacture of posts of different weights and strengths for different applications, using selected sheet material thicknesses. A light weight sheet of thin material lends itself to uses such as market gardening and nurseries. Medium weight members are also usable in certain nurseries and perhaps for carrying reflectors at road edges, and yet again for use as components of fabricated beams and other structural members in buildings and the like. Heavier articles are ideal for normal fencing or as tree supports, while the articles of heaviest weights are applicable to cattle fencing and in outback uses such as fencing water courses which are flood prone.

Figure 9:
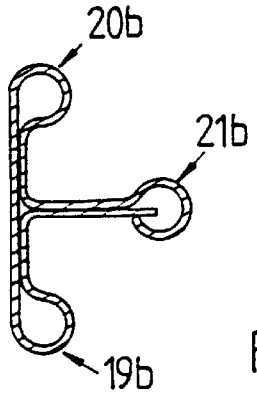
FIG. 9 is a cross-sectional view of a member constituting a variation of that shown in FIG. 6.
Figure 10:
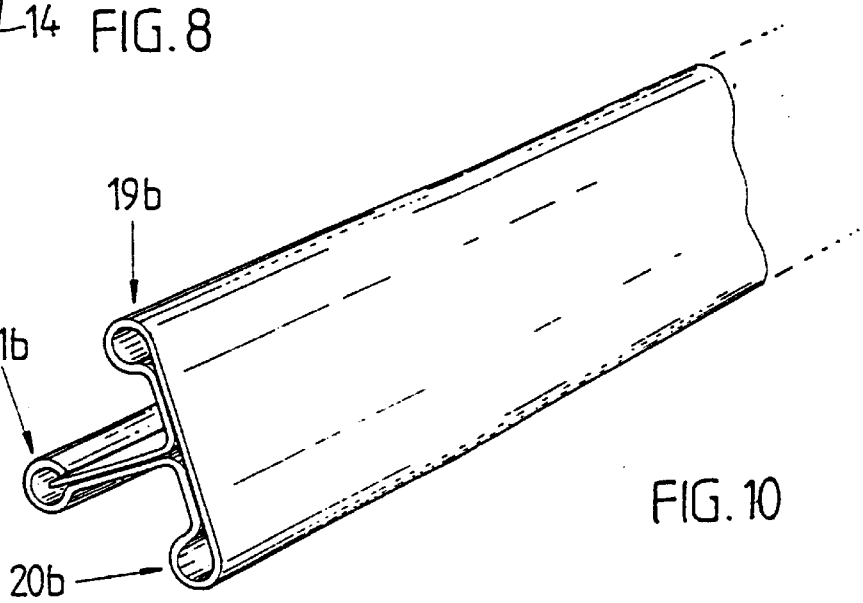
FIG. 10 shows in perspective view a length of metal section corresponding to FIG. 9.

While fence posts and other elongate articles in accordance with the descriptions herein will therefore be found very effective in achieving the objects for which the invention has been devised, it will of course be understood that these embodiments are illustrative only and may be subject to many further modifications of detail and design. For example the embodiment shown in FIGS. 9 and 10 is substantially identical with that of FIG. 6 except that the box-section formations 19*b*, 20*b* and 21*b* are fully arcuate instead of triangular as will be readily apparent to persons skilled in the art. Accordingly, the invention is to be deemed to embrace all variations as fall within its broad scope and ambit, as defined by the appended claims.

We claim:

1. An elongate member usable as a fence post, formed to constant cross-section from a single metal sheet by a suitable sheet metal roll forming process, said member when viewed in cross-section having three arm sections each of double sheet metal thickness, said double sheet metal thickness comprising two lengths of said single metal sheet substantially in contact with each other along their length, said arm sections radiating from a junction, two of said arm sections at their outer edges remote from the junction having their two sheet sections joined through an integral arcuate or other box-section formation, while the third arm section has a like formation in which a first free terminal edge of said single metal sheet is contained within a terminal roll formed by a second free terminal edge of said single metal sheet, said arcuate or other box-section formations being uninterrupted along a length of said elongate member.

2. An elongate member according to claim 1, wherein the three arm sections are of substantially equal lengths and are disposed at about equal angles to one another.

3. An elongate member according to claim 1, wherein said two of said arm sections are substantially coplanar, while said third arm section extends at right angles thereto from its junction therewith.

4. An elongate member according to claim 3, wherein said third arm section is the one in which at its outer edge the first free terminal edge of said single metal sheet is contained within said terminal roll formed by said second free terminal edge of said single metal sheet.

5. An elongate member according to claim 3, wherein the box-section formation at the outer edge of each arm section is of near-triangular form.

6. An elongate member according to claim 3, wherein the two substantially coplanar arm sections have their faces remote from the third arm section constituting a flat web adapted to accommodate a road marking sheet.

7. An elongate member according claim 1, wherein the box-section formation at the outer edge of each arm section is of near-circular form.

8. An elongate member according to claim 1, wherein apertures to receive wire are provided at intervals along at least one said arm section to facilitate use as said fence post.

9. An elongate member according to claim 1, wherein one end of said elongate member is shaped to a point to facilitate driving into the ground.

* * * * *

UNITED STATES PATENT AND TRADEMARK OFFICE

CERTIFICATE OF CORRECTION

PATENT NO. : 5,860,636

DATED : January 19, 1999

INVENTOR(S) : Ernest John Duncan, et al.

It is certified that error appears in the above-identified patent and that said Letters Patent is hereby corrected as shown below:

Column 2, line 17, change "A-A" to --1-1--.

Signed and Sealed this

Sixteenth Day of March, 1999

*Attest:*

Q. TODD DICKINSON

*Attesting Officer*

*Acting Commissioner of Patents and Trademarks*